US009013364B1

(12) United States Patent
Gregoire et al.

(10) Patent No.: US 9,013,364 B1
(45) Date of Patent: Apr. 21, 2015

(54) ELECTROMAGNETICALLY OPERATIONAL MICRO-TRUSS STRUCTURE

(75) Inventors: Daniel J. Gregoire, Thousand Oaks, CA (US); James H. Schaffner, Chatsworth, CA (US)

(73) Assignee: The Boeing Company, Chicago, IL (US)

( * ) Notice: Subject to any disclaimer, the term of this patent is extended or adjusted under 35 U.S.C. 154(b) by 495 days.

(21) Appl. No.: 13/298,161

(22) Filed: Nov. 16, 2011

(51) Int. Cl.
*H01Q 21/00* (2006.01)
*H01Q 9/06* (2006.01)

(52) U.S. Cl.
CPC ..... *H01Q 9/06* (2013.01)

(58) Field of Classification Search
CPC ... H01Q 15/168; H01Q 1/425; H01Q 15/006; H01Q 15/008; H01Q 15/0086
USPC ..... 343/909, 756, 878, 879
See application file for complete search history.

(56) References Cited

U.S. PATENT DOCUMENTS

| | | | | |
|---|---|---|---|---|
| 6,094,171 | A | 7/2000 | Riddle et al. | |
| 8,320,727 | B1 * | 11/2012 | Jacobsen et al. | 385/129 |
| 2005/0154567 | A1 * | 7/2005 | Jackman et al. | 703/2 |

OTHER PUBLICATIONS

D. J. Gregoire and J. S. Colburn, "Artificial Impedance Surface Antenna Design and Simulation", Proceedings of the 2010 Antenna Applications Symposium, vol. I, 2010, pp. 288-303.

J. S. Colburn, D. F. Sievenpiper, B. H. Fong, J. J. Ottusch, J. L. Visher and P. R. Herz "Advances in Artificial Impedance Surface Conformal Antennas" IEEE Antennas and Propagation International Symposium 2007.

Paul J. Callus, "Conformal Load-Bearing Antenna Structure for Australian Defence Force Aircraft", Australian Government, Air Vehicles Division Defence Science and Technology Organization, DSTO-TR-1963, DSTO Platforms Sciences Laboratory, 2007.

Dan Sievenpiper, Lijun Zhang, Romulo F. Jimenez Broas, Nicholas G. Alexopolous, Eli Yablanovitch, "High-Impedance Electromagnetic Surfaces with a Forbidden Frequency Band", IEEE Transactions on Antennas and Propagation, AP-47. Nov. 11, 1999, pp. 2059-2074.

Dan Sievenpiper, Joe Colburn, Bryan Fong, John Ottusch, John Visher, "Holographic Artificial Impedance Surfaces for Conformal Antennas", IEEE Antennas and Propagation Society International Symposium 2005, vol. 1B, pp. 256-259.

A. J. Jacobsen, W. B.-Carter, and S. Nutt, "Micro-scale Truss Structures formed from Self-Propagating Photopolymer Waveguides," Advanced Materials, vol. 19, 2007, pp. 3892-3896.

* cited by examiner

*Primary Examiner* — Dieu H Duong
(74) *Attorney, Agent, or Firm* — Ameh IP; Lowell Campbell; Elahe Toosi

(57) ABSTRACT

An electromagnetically operational micro-truss structure and methods are disclosed. A micro-truss structure comprises a grid of interlocking elements, and a metallic coating selectively coats the grid. The metallic coating is configured to resonate an electromagnetic energy.

17 Claims, 4 Drawing Sheets

ELECTROMAGNETICALLY OPERATIONAL MICRO-TRUSS STRUCTURE

FIELD

Embodiments of the present disclosure relate generally to antennas. More particularly, embodiments of the present disclosure relate to antenna structures.

BACKGROUND

Current microwave and millimeter-wave frequency antennas generally comprise cumbersome structures such as waveguides, dish antennas, helical coils, horns, and other large non-conformal structures. Communication applications where at least one communicator is moving and radar applications generally require a steerable beam and/or steerable reception. Phased array antennas are particularly useful for beam steered applications since beam steering can be accomplished electronically without physical motion of the antenna. Such electronic beam steering can be faster and more accurate and reliable than gimbaled/motor-driven mechanical antenna steering.

SUMMARY

An electromagnetically operational micro-truss structure and methods are disclosed. A micro-truss structure comprises a grid of interlocking elements, and a metallic coating selectively coats the grid. The metallic coating is configured to resonate an electromagnetic energy.

In this manner, the electromagnetically operational micro-truss structure may be formed into various shapes operable to bear structural weight and provide, for example but without limitation, an antenna, a conformal antenna, a holographic antenna, a frequency selective surface, or other electromagnetic device.

In an embodiment, an electromagnetically operational micro-truss structure comprises a micro-truss structure and a metallic coating. The micro-truss structure comprises a grid of interlocking elements, and the metallic coating selectively coats the grid. The metallic coating is configured to resonate an electromagnetic energy.

In another embodiment, a method for operation of an electromagnetically operational micro-truss structure uses a micro-truss structure comprising a grid of interlocking elements selectively coated with a metallic coating. The method further resonates an electromagnetic energy using the metallic coating.

In a further embodiment, a method for providing an electromagnetically operational micro-truss structure provides a micro-truss structure comprising a grid of interlocking elements. The method further selectively coats the grid with a metallic coating, and configures the metallic coating to resonate an electromagnetic energy.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
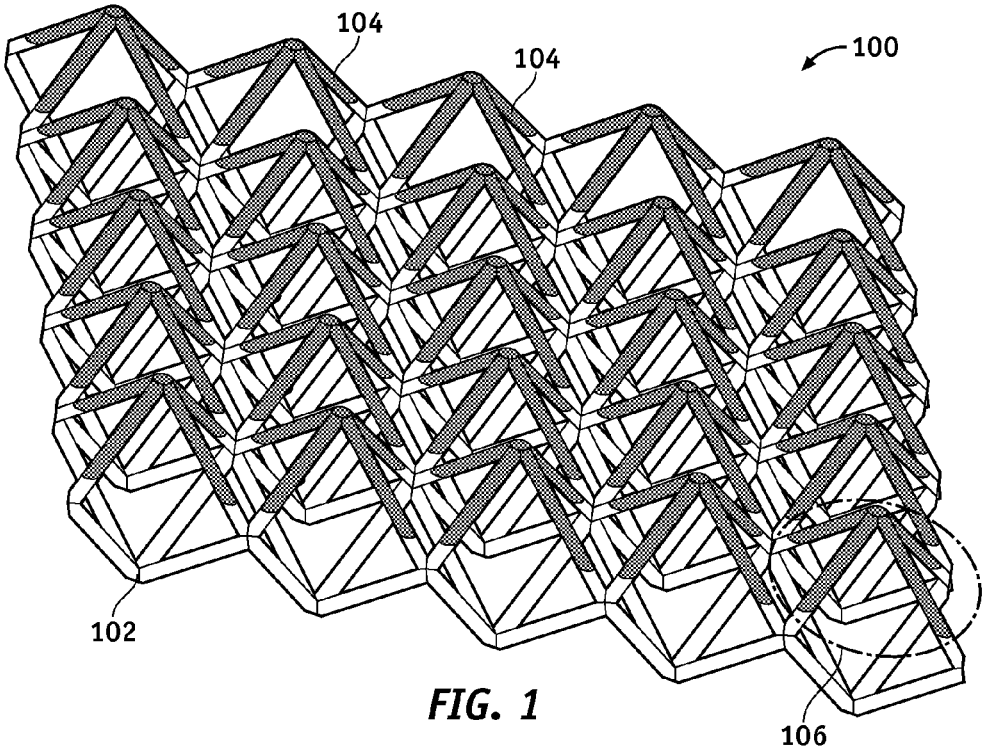
FIG. 1 is an illustration of an exemplary electromagnetically operational micro-truss structure according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to antennas, micro-truss structures, and other functional aspects of systems described herein (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a practical non-limiting application, namely, a conformal antenna and frequency selective filter that can be meld into a vehicle structure of a vehicle. The vehicle may comprise, for example but without limitation, an unmanned aerial vehicles (UAVs), a piloted aircraft (e.g., a fixed wing or a rotorcraft), a satellite, a ship, a boat, a submarine, a surface vehicle (e.g., an automobile), a robotic vehicle, an autonomous robotic vehicle, or other vehicle. Embodiments of the disclosure, however, are not limited to such conformal antenna and frequency selective filter applications, and the techniques described herein may also be utilized in other applications. For example but without limitation, embodiments may be applicable to radomes, shielding, or other application.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Embodiments of the disclosure provide an electromagnetically operational micro-truss structure operable to resonate an electromagnetic energy. The electromagnetically operational micro-truss structure comprises a micro-truss structure comprising a grid of interlocking elements, and a metallic coating selectively coating the grid. As mentioned above, the electromagnetically operational micro-truss structure may be formed into various shapes to provide, for example but without limitation, an antenna operable to bear structural weight, a conformal antenna, a holographic antenna, frequency selective surface, or other electromagnetic device.

FIG. 1 is an illustration of an exemplary electromagnetically operational micro-truss structure (structure 100) according to an embodiment of the disclosure. The structure 100 comprises a micro-truss structure 102 and a metallic coating 104.

Figure 2:
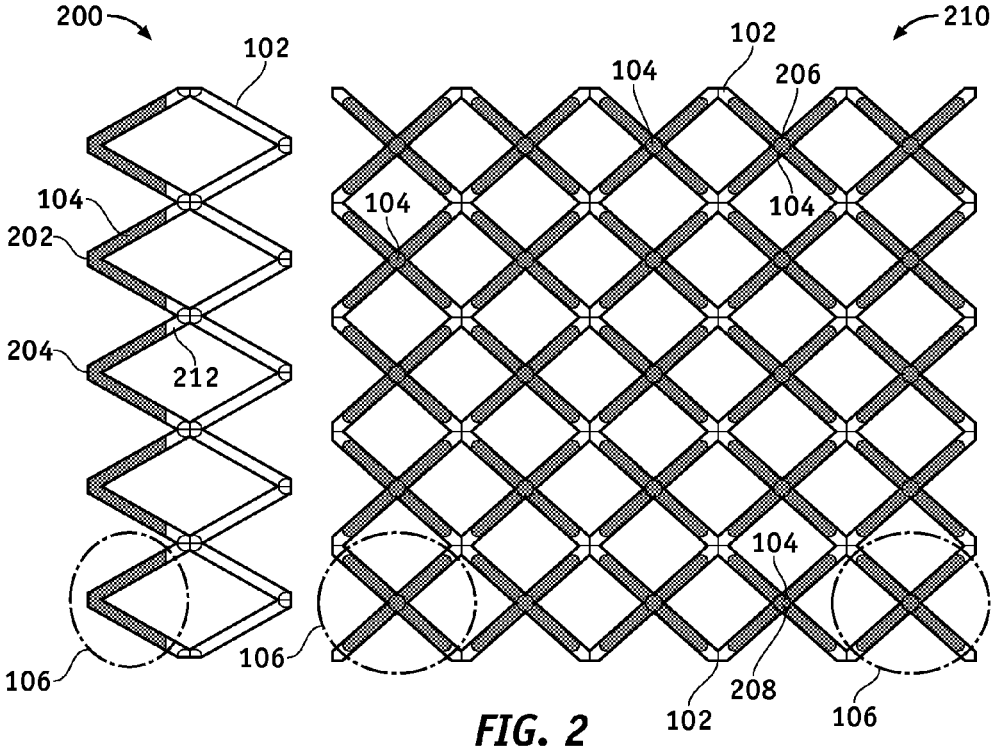
FIG. 2 is an illustration of an exemplary side view and top view of the electromagnetically operational micro-truss structure of FIG. 1 according to an embodiment of the disclosure.

The micro-truss structure 102 comprises a structural grid of interlocking elements (e.g., truss member 212 in FIG. 2). The micro-truss structure 102 provides a high-impedance surface upon which the metallic coating 104 is applied. The micro-truss structure 102 may comprise a non-metallic material such as, but without limitation, a plastic, a composite, a ceramic, a polymer, or other non-metallic material.

The metallic coating 104 is coupled to the micro-truss structure 102. The metallic coating 104 may be applied to the micro-truss structure 102 by various methods comprising, for example but without limitation, partial metallization by sputter deposition with a mask, electroless plating, a paint dip, or other method for coating a surface.

A holographic antenna can be created by making a conformal antenna by guiding surface waves along a periodically varying high-impedance surface comprising the high-impedance surface provided by the micro-truss structure 102. A partial metallization of the micro-truss structure 102 creates the structure 100 as a high-impedance structure comprising a periodic array of metallic bent crosses 106 coated by the metallic coating 104 in the structure 100 that is capable of supporting a surface wave. A size of each of the metallic bent crosses 106 can be varied to create the holographic antenna as explained in more detail below. When integrated into terrestrial or aerospace vehicle structures, the structural antenna 100 can increase design flexibility, decrease weight and increase strength. Embodiments of the disclosure can also be used to integrate structural antennas into complex shapes, thus increasing design flexibility.

FIG. 2 is an illustration of an exemplary side view 200 and top view 210 of the structure 100 of FIG. 1 according to an embodiment of the disclosure. In the side view 200, the micro-truss structure 102 is coated by the metallic coating 104 (FIG. 1) at locations such as a first location 202 and a second location 204. The micro-truss structure 102 is transformed into an electromagnetically resonating structure such as a structural holographic antenna by selectively and partially coating truss members such as a truss member 212 with a metal at locations such as the first location 202 and the second location 204. In the top view 210, the micro-truss structure 102 is coated by the metallic coating 104 at locations such as a third location 206 and a fourth location 208.

Figure 3:
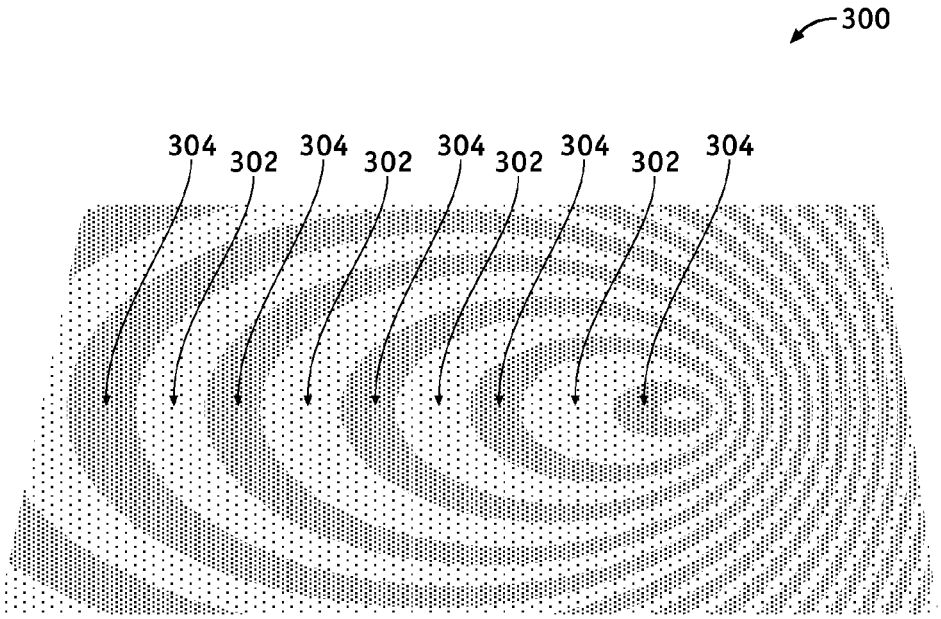
FIG. 3 is an illustration of an exemplary conformal antenna formed from an electromagnetically operational micro-truss structure according to an embodiment of the disclosure.

FIG. 3 is an illustration of an exemplary conformal antenna 300 (structural antenna 300) formed from the electromagnetically operational micro-truss structure 100 of FIG. 1 according to an embodiment of the disclosure. A light region 302 and a dark region 304 shown on the structural antenna 300 correspond to areas where the metallic coating 104 extends over smaller and larger portions of the micro-truss structure 102 respectively.

The conformal antenna 300 comprises a patterning of a metallic coating 104 of the structure 100. When truss members such as the truss member 212 are uniformly coated as shown in FIG. 1, the metallic coating 104 forms a periodic array of metallic bent crosses 106 (FIG. 1) that act as the high-impedance surface mentioned above and is capable of supporting surface-wave transmission at a propagation surface wave number determined by a period of a relative size of the metallic bent crosses 106 of the micro-truss structure 102. In general, a wavelength of a propagating surface wave decreases with a size of each of the metallic bent crosses 106 relative to the micro-truss period of the periodic array. A relative size of each of the metallic bent crosses 106 is determined by an amount of metallization applied locally to the micro-truss structure 102.

A holographic antenna is typically designed by applying a pattern to a surface wave propagation index $n_{sw}(x)$ locally according to a specific formula designed to create a radiation pattern peaked at a desired frequency f, and angle $\theta_0$. Such a formula can take a following form for the surface wave propagation index:

$$n_{sw}(x)=n_0+\delta n\cos(k_p x);\ \text{where } k_p=2\pi f/c(n_0-\sin(\theta_0)) \quad (1)$$

where $n_0$ is a mean surface-wave index, $\delta n$ is a modulation amplitude of the surface-wave index, and c is the speed of light.

When a functional dependence of the surface-wave propagation index $n_{sw}(x)$ relative to the size of each of the bent crosses 106 is known, an antenna such as the conformal antenna 300 can be designed into the structure 100 according to Eqn. (1).

According to an embodiment, the structural antenna 300 can be used to meld antennas into a vehicle structure. The structural antenna 300 provides design flexibility, reduced weight and increased strength, and can be easily formed into shapes with complex curvature. When used on an aircraft, embodiments of the disclosure offer advantages in that a size of an antenna aperture is less constrained, and may be as large as or larger than wings and fuselage of an aircraft.

Some existing antennas incorporate an exciting element such as a slot aperture into a structure, with a disadvantage that the structure must be modified with an aperture, and a radiation pattern is determined by a geometry of the structure. In contrast, according to embodiments of the disclosure, a radiation pattern is tailored to suit an application by tailoring shapes and patterns of the partial metallization in the structure 100.

Figure 4:
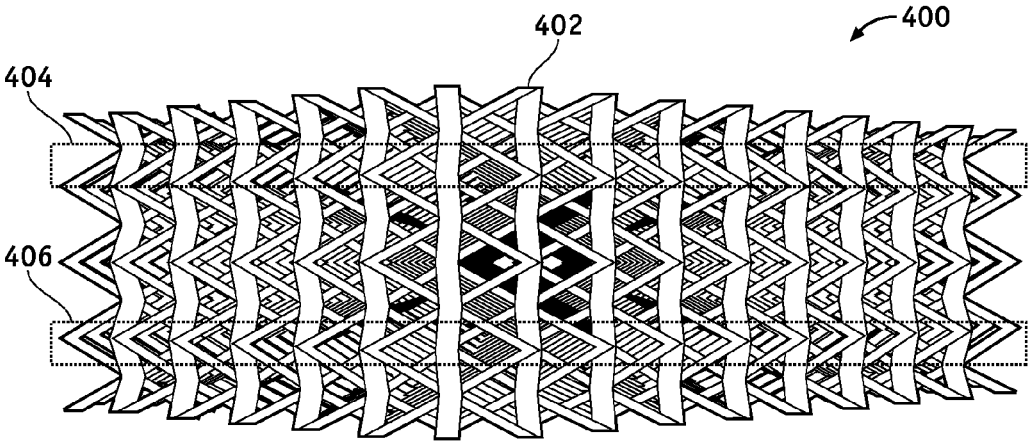
FIG. 4 is an illustration of an exemplary multilayer electromagnetically operational micro-truss structure according to an embodiment of the disclosure.

FIG. 4 is an illustration of an exemplary multilayer electromagnetically operational micro-truss structure 400 (structure 400) according to an embodiment of the disclosure. The structure 400 comprises a micro-truss structure 402, a first metal coated layer 404 and a second metal coated layer 406 (layers 404/406). The structure 400 may be configured to comprise a structural frequency selective surface whose geometry filters electromagnetic radiation. The structure 400 can be configured as a frequency selective surface by directly writing a metallic pattern on a surface of the structure 100

(FIG. 1). In this manner, the structure 400 may also be referred to as a frequency selective surface 400 herein.

The micro-truss structure 402 can be transformed into a structural frequency selective surface by selectively and partially coating truss members such as the truss member 212 with metal as explained in the context of discussion of FIG. 1. The partial metallization creates the periodic array of the metallic bent crosses 106 (FIG. 1) in the micro-truss structure 402 that enables frequency selectivity. In some embodiments, a single layer such as the first layer 404 may be used to form a frequency selective surface on the micro-truss structure 402.

In some embodiments, multiple layers such as the first layer 404 and the second layer 406 may be used to form a frequency selective surface on the micro-truss structure 402. For example, the first layer 404 may comprise a higher pass filter with a first cutoff frequency, and the second layer 406 may comprise a low pass filter with a second cutoff frequency higher than the first cutoff frequency. Thereby, the first layer 404 and the second layer 406 may comprise a band pass filter. A frequency selective surface may employ a band pass filter for frequency selectivity.

Figure 5:
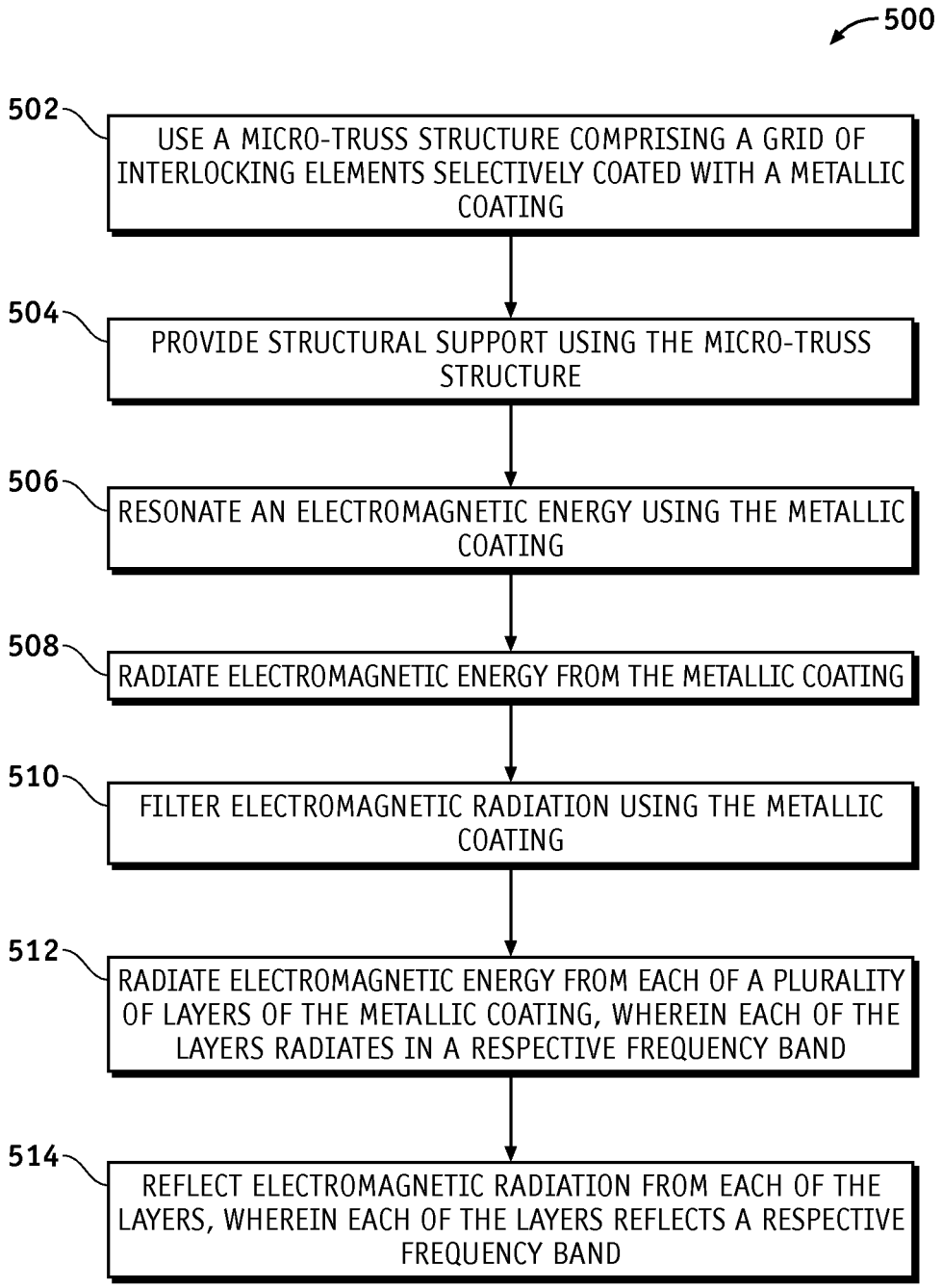
FIG. 5 is an illustration of an exemplary flowchart showing a process for operating an electromagnetically operational micro-truss structure according to an embodiment of the disclosure.

FIG. 5 is an illustration of an exemplary flowchart showing a process 500 for operating an electromagnetically operational micro-truss structure according to an embodiment of the disclosure. The various tasks performed in connection with process 500 may be performed mechanically, by software, hardware, firmware, a computer-readable medium having computer executable instructions for performing the processes methods, or any combination thereof. For illustrative purposes, the following description of the process 500 may refer to elements mentioned above in connection with FIGS. 1-4.

It should be appreciated that the process 500 may include any number of additional or alternative tasks, the tasks shown in FIG. 5 need not be performed in the illustrated order, and the process 500 may be incorporated into a more comprehensive procedure or process having additional functionality not described in detail herein. In practical embodiments, portions of the process 500 may be performed by different elements of the structure 100, 400 and the structural antenna 300 such as: the micro-truss structure 102 and the metallic coating 104 the, etc. Process 500 may have functions, material, and structures that are similar to the embodiments shown in FIGS. 1-4. Therefore, common features, functions, and elements may not be redundantly described here.

Process 500 may begin by using a micro-truss structure such as the micro-truss structure 102 comprising a grid of interlocking elements such as a truss member 212 selectively coated with a metal coating such as the metallic coating 104 (task 502).

Process 500 may continue by providing structural support using the micro-truss structure 102 (task 504).

Process 500 may continue by resonating an electromagnetic energy using the metallic coating 104 (task 506).

Process 500 may continue by radiating electromagnetic energy from the metallic coating 104 (task 508). Thereby, the metallic coating 104 and the micro-truss structure 102 function as an antenna such as the structural antenna 300.

Process 500 may continue by filtering electromagnetic radiation using the metallic coating 104 (task 510). Thereby, the metallic coating 104 and the micro-truss structure 102 function as a frequency selective surface such as the frequency selective surface 400.

Process 500 may continue by radiating electromagnetic energy from each of a plurality of layers of the metallic coating 104 such as the layers 404/406, wherein each of the layers 404/406 radiates in a respective frequency band (task 512).

Process 500 may continue by reflecting electromagnetic radiation from each of the layers 404/406, wherein each of the layers 404/406 reflects a respective frequency band (task 514).

Figure 6:
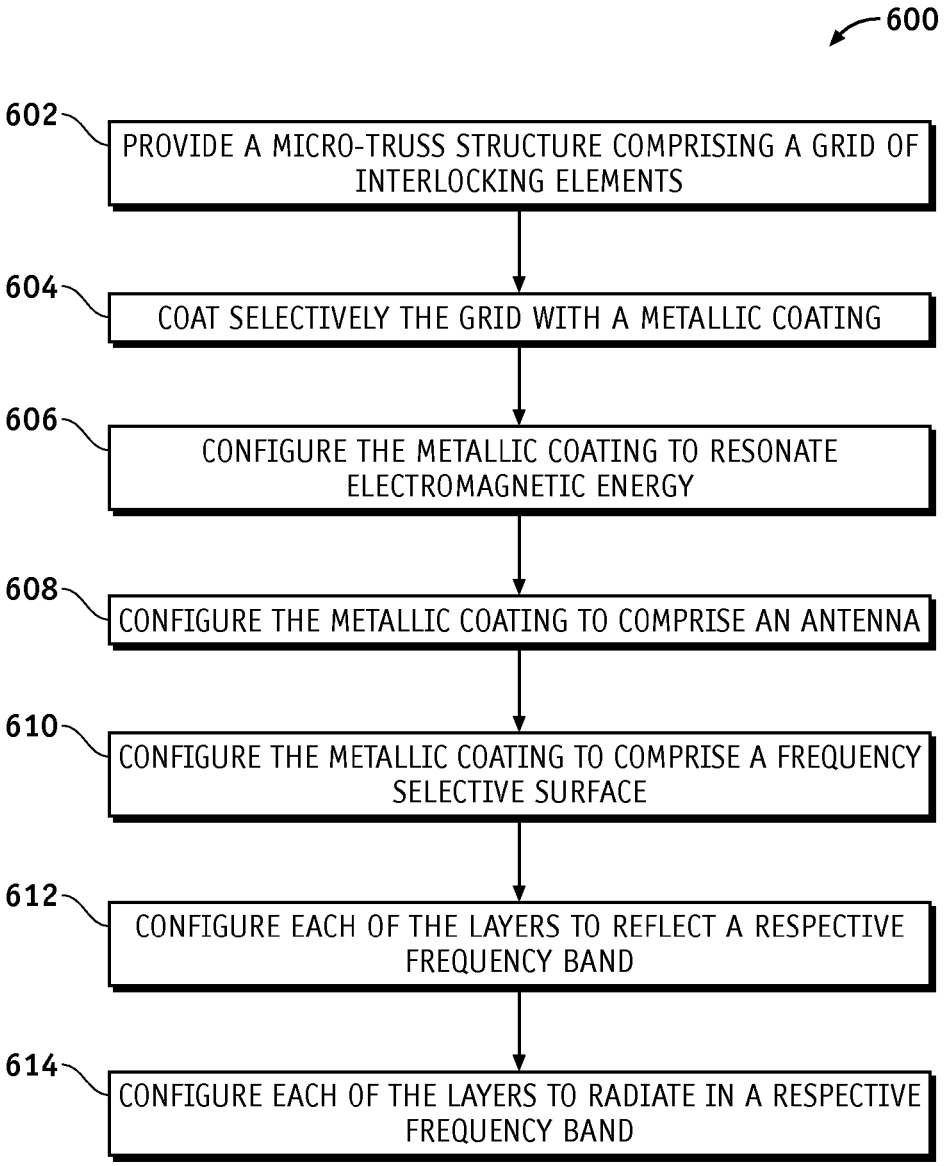
FIG. 6 is an illustration of an exemplary flowchart showing a process for providing an electromagnetically operational micro-truss structure according to an embodiment of the disclosure.

FIG. 6 is an illustration of an exemplary flowchart showing a process 600 for providing an electromagnetically operational micro-truss structure according to an embodiment of the disclosure. The various tasks performed in connection with the process 600 may be performed mechanically, by software, hardware, firmware, a computer-readable medium having computer executable instructions for performing the processes methods, or any combination thereof. For illustrative purposes, the following description of the process 600 may refer to elements mentioned above in connection with FIGS. 1-4.

It should be appreciated that the process 600 may include any number of additional or alternative tasks, the tasks shown in FIG. 6 need not be performed in the illustrated order, and the process 600 may be incorporated into a more comprehensive procedure or process having additional functionality not described in detail herein. In practical embodiments, portions of the process 600 may be performed by different elements of the structure 100, 400 and the antenna structure 300 such as: a micro-truss structure 102 and a metallic coating 104 etc. Process 600 may have functions, material, and structures that are similar to the embodiments shown in FIGS. 1-4. Therefore, common features, functions, and elements may not be redundantly described here.

Process 600 may begin by providing a micro-truss structure such as the micro-truss structure 102 comprising a grid of interlocking elements such as a truss member 212 (task 602).

Process 600 may continue by coating selectively the grid with a metallic coating such as the metallic coating 104 (task 604).

Process 600 may continue by configuring the metallic coating 104 to resonate an electromagnetic energy (task 606).

Process 600 may continue by configuring the metallic coating 104 to comprise an antenna such as the structural antenna 300 (task 608).

Process 600 may continue by configuring the metallic coating 104 to comprise a frequency selective surface such as the frequency selective surface 400 (task 610).

Process 600 may continue by configuring each of a plurality of layers such as the layers 404/406 to reflect a respective frequency band, wherein the metallic coating comprises the layers 404/406 (task 612).

Process 600 may continue by configuring each of the layers 404/406 to radiate in a respective frequency band (task 614).

In this manner, embodiments of the disclosure provide an electromagnetically operational micro-truss structure that may be formed into various shapes to provide, for example but without limitation, an antenna operable to bear structural weight, a conformal antenna, a holographic antenna, a frequency selective surface, or other electromagnetic devices. Conventional methods may be difficult to incorporate into complex curvatures where design, manufacture and maintenance costs increase with shape complexity. Embodiments of the disclosure are a significant departure in that the structure is the antenna or is the frequency-selective surface, unlike existing methods where an antenna or frequency selective surface are a conventional separate device from a structure.

In this document, the terms "computer program product", "computer-readable medium", "computer readable storage medium", and the like may be used generally to refer to media such as, for example, memory, storage devices, or storage unit. These and other forms of computer-readable media may be involved in storing one or more instructions for use by a controller to cause the controller to perform specified operations. Such instructions, generally referred to as "computer program code" or "program code" (which may be grouped in the form of computer programs or other groupings), when executed, enable a method for electromagnetic operation of the micro-truss structure 100.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-4 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. A electromagnetically operational micro-truss structure comprising:

a micro-truss structure comprising a grid of interlocking elements; and a metallic coating selectively coating the grid, the metallic coating configured to resonate an electromagnetic energy, wherein the metallic coating comprises an antenna.

2. The electromagnetically operational micro-truss structure of claim 1, wherein the metallic coating comprises a frequency selective surface.

3. The electromagnetically operational micro-truss structure of claim 1, wherein the metallic coating comprises a plurality of layers.

4. The electromagnetically operational micro-truss structure of claim 3, wherein each of the layers is operable to reflect a respective frequency band.

5. The electromagnetically operational micro-truss structure of claim 3, wherein each of the layers is operable to radiate in a respective frequency band.

6. The electromagnetically operational micro-truss structure of claim 1, wherein the micro-truss structure comprises a non-metallic material.

7. A method for operating an electromagnetically operational micro-truss structure, the method comprising:

using a micro-truss structure comprising a grid of interlocking elements selectively coated with a metallic coating;

resonating an electromagnetic energy using the metallic coating; and radiating electromagnetic energy from the metallic coating.

8. The method of claim 7, further comprising providing structural support using the micro-truss structure.

9. The method of claim 7, further comprising filtering electromagnetic radiation using the metallic coating.

10. The method of claim 7, wherein the metallic coating comprises a plurality of layers.

11. The method of claim 10, further comprising radiating electromagnetic energy from each of the layers, wherein each of the layers radiates in a respective frequency band.

12. The method of claim 10, further comprising reflecting electromagnetic radiation from each of the layers, wherein each of the layers reflects a respective frequency band.

13. A method for providing an electromagnetically operational micro-truss structure, the method comprising:

providing a micro-truss structure comprising a grid of interlocking elements;

selectively coating the grid with a metallic coating;

configuring the metallic coating to resonate an electromagnetic energy; and configuring the metallic coating to comprise an antenna.

14. The method of claim 13, further comprising configuring the metallic coating to comprise a frequency selective surface.

15. The method of claim 13, wherein the metallic coating comprises a plurality of layers.

16. The method of claim 15, further comprising configuring each of the layers to reflect a respective frequency band.

17. The method of claim 15, further comprising configuring each of the layers to radiate in a respective a frequency band.

* * * * *